United States Patent [19]

Little

[11] 3,952,605

[45] Apr. 27, 1976

[54] LOCK ACTUATOR

[75] Inventor: Carl H. Little, Jamestown, N.Y.

[73] Assignee: Keeler Brass Company, Grand Rapids, Mich.

[22] Filed: Aug. 14, 1974

[21] Appl. No.: 497,330

[52] U.S. Cl. ..... 74/99 R; 70/101; 74/107

[51] Int. Cl.[2] ..... F16H 25/18

[58] Field of Search ..... 74/107, 104, 103, 102, 74/99 R, 89.19, 89.18, 89.17, 89.16, 575

[56] References Cited

UNITED STATES PATENTS

| | | | |
|---|---|---|---|
| 2,180,501 | 11/1939 | Blood | 74/104 X |
| 3,626,452 | 12/1971 | Winter et al. | 74/575 X |
| 3,672,262 | 6/1972 | Karr | 74/104 X |

*Primary Examiner*—Samuel Scott
*Assistant Examiner*—F. D. Shoemaker
*Attorney, Agent, or Firm*—Price, Heneveld, Huizenga & Cooper

[57] ABSTRACT

An actuator assembly for converting linear movement to rotational movement for operating a lock assembly for locking and unlocking doors and the like. The assembly includes an axially shiftable shaft, a rotatable member associated with the shaft alternately rotatable in clockwise and counterclockwise directions with axial movement of the shaft, and cam and cam follower means for reversing the direction of the rotational movement of the rotatable member after each cycle of axial movement of the shaft.

17 Claims, 14 Drawing Figures

LOCK ACTUATOR

BACKGROUND OF THE INVENTION

This invention relates to an actuator assembly and more particularly, to an actuator assembly for converting linear movement to alternating clockwise and counterclockwise rotational movement.

A wide variety of actuators for converting linear movement to rotational movement have been developed and utilized in the past, typically for opening doors, operating locking mechanisms, etc., e.g., furnace doors, automobile vent windows, automobile heating and air conditioning duct doors, door locks, etc. These actuators generally include some type of linear motive means such as a vacuum motor and some type of gear arrangement, e.g., a worm gear assembly to convert the linear movement of the vacuum motor to a rotational movement which acts upon the door or the like which is to be moved through an arc or rotated. Clockwise and counterclockwise rotational movement is generally accomplished by changing the direction of linear movement of the vacuum motor, i.e., by reversing the motor. Although some of these actuators have been generally satisfactory, they have some disadvantages such as bulkiness, complicated linkages, unreliability, and high cost of manufacture. Accordingly, there is a continuing need for improved actuators to eliminate the above disadvantages.

SUMMARY OF THE INVENTION

According to the present invention, there is provided an actuator assembly for converting linear movement to rotational movement which is compact, reliable, and inexpensive to manufacture. The actuator is particularly adapted for operating the locking mechanism in an automobile door latch. The actuator assembly includes an elongated shaft and means as a solenoid and spring return means for producing linear movement of the shaft along its axial length in both directions and a rotatable member. Shiftable cam and cam follower means associated with the shaft and rotatable member are operable with linear movement of the shaft to produce alternating clockwise and counterclockwise rotational movement of the rotatable member. The direction of the rotational movement alternates after each cycle of axial movement of the shaft in both axial directions. The shaft is slidably mounted for linear movement along its length and has a transverse bore therethrough. A cam follower pin slidably received in the bore has a length slightly greater than the diameter of the shaft and is shiftable between a first position where one end of the follower pin operates the rotating member and a second position where the other end of the follower pin operates the rotatable member in the opposite direction. Preferably, a solenoid or a vacuum motor is used to produce axial movement of the shaft in one direction and a biasing means such as a coil spring is employed to urge the shaft in the opposite axial direction.

The rotatable member is positioned adjacent the shaft with its axis of rotation being generally perpendicular to the axis of the shaft. Abutment members extend upwardly from the rotatable member on each side of the shaft for engagement by the follower pin. The means for alternating the direction of rotational movement of the rotatable member includes a pair of arm members pivotally mounted adjacent the rotatable member. When the shaft is in a starting position in each cycle, one arm is in abutting contact at one end with the follower pin and at the other end with a camming surface on the rotatable member. The camming surface acts to alternately move the arms to shift the follower pin during each cycle of axial linear movement so as to alternately engage the abutment members after each cycle of linear movement of the shaft.

The actuator assembly is particularly adapted for use with a locking mechanism for an automobile door that includes a movable lock activator element. The actuator assembly converts linear movement to a rotational movement to move the lock activator element between locked and unlocked positions.

DESCRIPTION OF THE PREFERRED EMBODIMENT

Figures 1, 2:
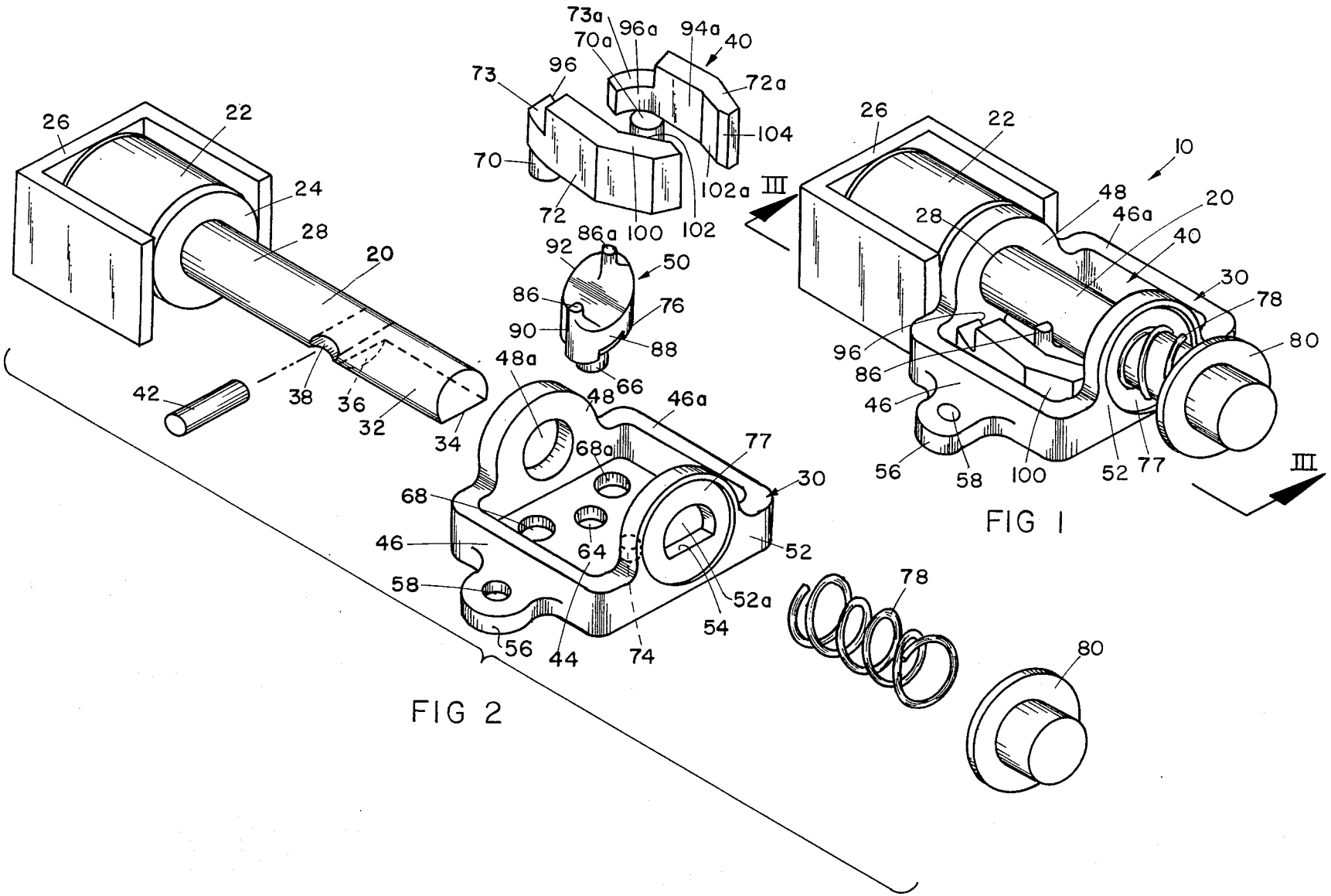
FIG. 1 is a perspective view of the actuator assembly of the present invention.
FIG. 2 is an exploded perspective view of the actuator assembly of FIG. 1.

Referring to FIGS. 1 through 5 of the drawings, the actuator assembly of the invention is generally designated by the numeral 10 and includes an elongated rod-like first member or shaft 20 linearly movable with respect to a supporting framework 30. Shaft 20 cooperatively operates with a cam and cam follower assembly 40 to impart rotary motion to a rotatable member 50.

Figure 13:
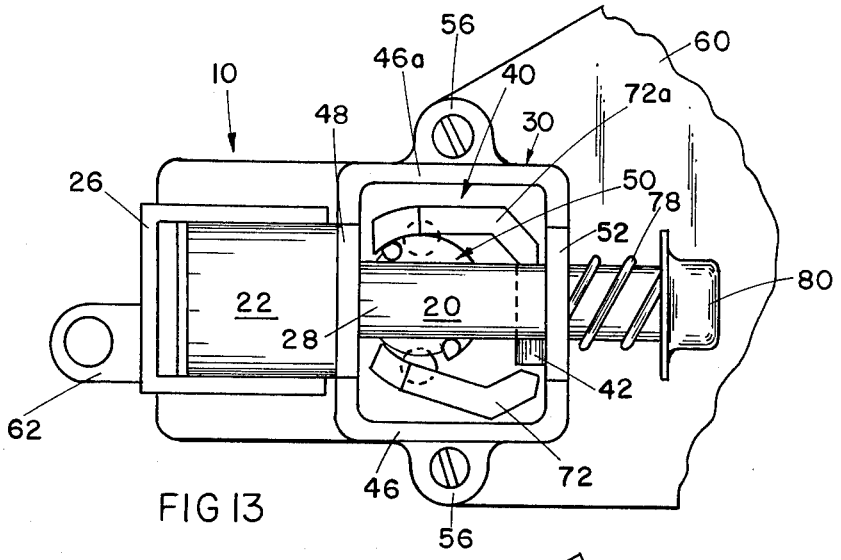
FIGS. 13 and 14 are top plan views of the activator assembly showing successive positions of the lock activating mechanism during cycles of linear movement of the shaft.
Figure 14:
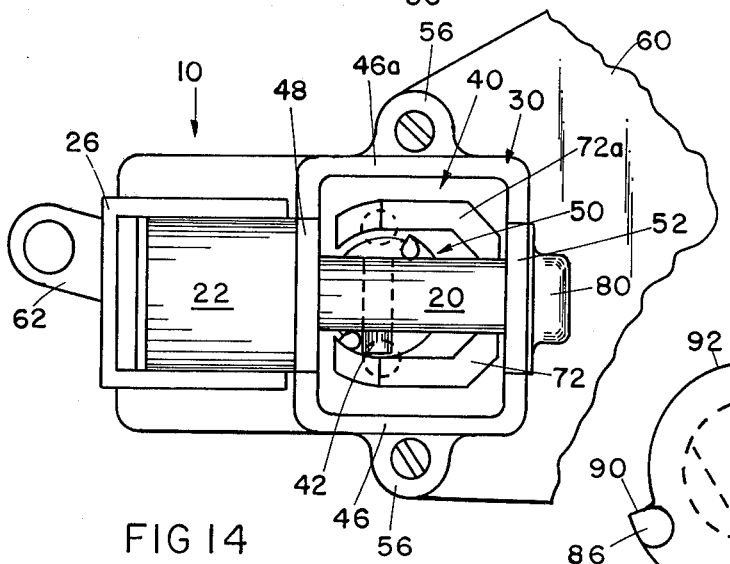

Actuator assembly 10 is adapted generally for mounting on an automobile door lock mechanism 60 (FIGS. 3, 13 and 14) to operate a lock activator element 62 to automatically lock and unlock door locking mechanism 60. Door lock mechanism 60 is of conventional design and may be of the type normally utilized in an automotive door assembly. Lock activator element 62 may be shifted manually as by a rod (not shown) extending through the automobile door casing into the interior of the vehicle or from the exterior as by a key or the like. The actuator of the present assembly is particularly adapted for use with door lock assemblies in a vehicle wherein the locks for the several doors of the vehicle may be simultaneously remotely operated by a single switch to allow the operator to effect locking or unlocking of all of the doors in the vehicle. In any of the several modes of operation, lock activator element 62 is shifted between the positions shown in FIGS. 13 and 14 to effect either locking or unlocking of door lock mechanism 60.

Shaft 20 is shifted between first and second positions to effect alternate clockwise and counterclockwise rotation of plate member 50 through each cycle of operation. Shaft 20 may be actuated to move along its linear axis by any motive means as a vacuum motor or the like. In the preferred embodiment shown, shaft 20 is actuated for movement along its linear axis by an electromagnetic coil 22. Coil 22 is of conventional construction comprising many turns of wire wrapped around a core 24 which may be molded as an integral part of frame 30. The wire ends (not shown) are connected to a suitable power supply through switch means (also not shown) in a conventional manner. Coil 22 and the core 24 may be mounted in a generally U-shaped solenoid frame 26 which conveniently may be formed as an integral part of bracket means (not shown) for mounting actuator assembly 10 to the lock mechanism 60.

Shaft 20 includes a first portion 28 slidably received in the center of core 24. Coil 22, core 24, and portion 28 of shaft 20 cooperatively form a solenoid. The first portion 28 of shaft 20 serves as the solenoid armature and upon electrical energization of coil 22 is caused to move inwardly along its linear axis to effect rotation of rotating element 50 as will be hereinafter described.

The opposite end of shaft 20 designated by the numeral 32 is generally D-shaped, having a flat bottom surface 34 formed thereon. Flat surface 34 extends along a portion of the length of shaft 20 where it forms a step 36 (FIGS. 1 and 4) midway along the length of the shaft. An opening 38 extends through shaft 20 about an axis transverse to the axial length of the shaft and is adapted to receive a follower pin 42. Follower pin 42 has a length slightly greater than the outer diameter of shaft 20 and its diameter closely corresponds to the diameter of the transverse bore 38 so that there is a slight friction fit. Follower pin 42 is slidably received through shaft 20 and may be shifted selectively to extend either side of the linear axis of shaft 20.

Support frame 30 is generally box-like in configuration having an open top, bottom wall 44, side walls 46–46*a*, and end walls 48 and 52. End walls 48 and 52 extend upwardly and are provided with openings 48*a* and 52*a* respectively formed therethrough to slidably receive shaft 20. Opening 48*a* slidably receives end 28 of shaft 20 while opening 52*a* is generally D-shaped in configuration having a flat bottom surface 54 to slidably receive the D-shaped end 32 and flat portion 34 of shaft 20. The corresponding D-shaped configurations of the shaft and opening 52*a* prevent rotation of the shaft with respect to frame 30.

A pair of mounting flanges 56 extend outwardly from side walls 46 and 46*a* each having an opening 58 therethrough by which the framework 30 can be secured to lock mechanism 60 in a conventional manner.

Bottom wall 44 has a series of three carefully spaced openings. A central opening 64 is adapted to receive a stud member 66 extending from the lower surface of rotatable member 50 and serves as a pivot mounting therefor.

The two additional openings 68 and 68*a* are equally spaced on each side of pivot opening 64 to receive pivot stud members 70 and 70*a* extending downwardly from a pair of arm members 72 and 72*a* respectively. An upwardly extending pin 74 fastened in bottom wall 44 is received in a radial recess 76 formed in the bottom surface of rotatable member 50. Pin 74 provides a stop means abutting the ends of radial recess 76 to prevent excessive rotation of plate member 50 as will be hereinafter described.

Arms 72 and 72*a*, rotatable member 50 and follower pin 42 cooperatively operate to form the cam and cam follower mechanism 40 to cause alternating clockwise and counterclockwise rotation of rotatable member 50 upon each cycle of operation of the actuator.

A circular depression or recess 77 formed in end wall 52 surrounds D-shaped opening 52*a* and forms a seat to relieve one end of a coil spring 78. Spring 78 is positioned over end 32 of shaft 20 and is retained thereon by a flanged cap member 80. Spring 78 serves as a biasing means to hold the shaft 20 in a first or neutral position (FIGS. 1, 3, 6, 9, 12, and 13). Magnetic forces generated in coil 22 when energized, shift shaft 20 to the left against the bias of spring 78. When a circuit through the coil is disconnected, spring 78 returns shaft 20 to the first position.

Figure 5:
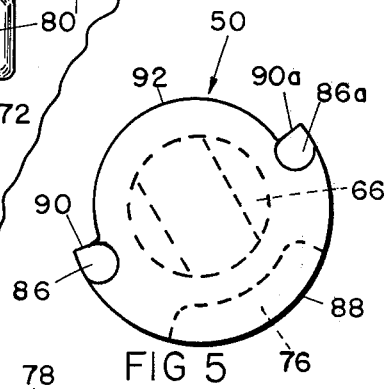
FIG. 5 is an enlarged top plan view of the rotatable member.
Figure 3:
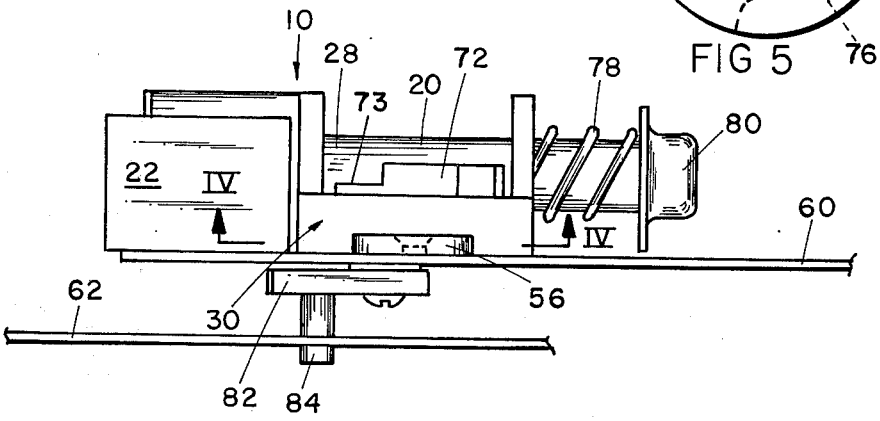
FIG. 3 is a side elevational view of the actuator assembly taken along line III—III of FIG. 1.
Figure 4:
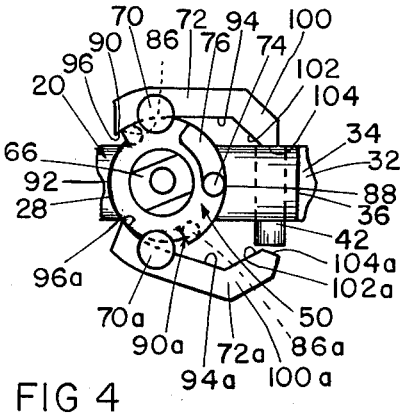
FIG. 4 is a simplified view of the bottom surface of the rotatable member and the arm members as viewed generally along the plane IV—IV of FIG. 3 with portions omitted for clarity.

Rotatable member 50 is preferably molded from a plastic like material as polycarbonate. Member 50 is generally disc like and circular in shape. As described above, stud 66 extends from its lower surface and when positioned in opening 64, forms its pivot axis. As shown in FIGS. 4 and 5, stud 66 may have a configured lower surface for connection to a link member 82 (FIG. 3) having a pin 84 extending therefrom for reception in lock activator element 62 for effecting shifting movement thereof.

The upper surface of rotatable member 50 (FIG. 5) includes two upwardly extending abutment members 86 and 86*a* which, when assembled in the framework, extend upwardly on each side of shaft 20 for selective engagement by follower pin 42 with movement of the shaft. The outer diameter of rotatable member 50 is divided into two diameter portions, the first or larger outer diameter portion 88 includes the abutment members 86 and 86*a*. Sharply defined steps 90 and 90*a* at the abutment members 86 and 86*a* extend radially inwardly to form a smaller diameter portion 92. The steps extend along the length of the rotatable member to the bottom surface. Recess 76 formed in the lower surface of rotatable member 50 opens outwardly radially into the larger diameter surface 88. The larger outer diameter surface 88 forms a cam surface operable against the inner facing surfaces 94 and 94*a* of arms 72 and 72*a* respectively to cooperatively form a pair of cam followers.

Referring to FIGS. 2 and 4, arms 72, 72*a* are identical in shape but mirror images of each other. Each arm is slightly C-shaped, and as previously mentioned, is pivoted by means of pivot studs 70 and 70*a* in openings 68 and 68*a* formed in the bottom wall 44 of frame 30. Since arms 70 and 70*a* are identical, only arm 70 will be described in detail. The corresponding portion of arm 70*a* will be identified with a similar reference numeral with the suffix letter a when necessary. It will be noted that the inner faces 94 of arms 72 extend generally along the center line of pivot stud 70 exposing approximately one-half of the top surface of stud 70. A curved surface portion 96 forming a short leg of arm 70 has an inner surface radius approximately equal to the radius of the large outer diameter portion 88 of rotatable member 50. Surface 96 passes generally through the axial center of stud 70. The remaining longer leg portion of inner face 94 extends in the opposite direction from stud 70 where it forms an inwardly turned leg 100. The inner face (with respect to shaft 20) of leg 100 forms a ramp surface 102 extending upwardly to a flat surface 104. Ramp surface 102 and flat surface 104 form a second cam surface at the end of arm member 72 to operatively engage and shift follower pin 42 along opening 38 as will be hereinafter described.

Arm members 72 and 72*a* also may be molded of plastic like material preferably acetal or the like. Studs 70 and 70*a* are integrally formed with the cam surfaces and the inner faces of the arms. It will be noted that an exposed portion of the top of studs 70 and 70*a* extend outwardly from the inner face surface of the arms such that when the arms are inserted in openings 68–68*a* of frame 30, the exposed top surface of each stud is generally flush with the top surface of bottom wall 44.

It will be noted that the relative positions of openings 64, 68, and 68*a* and the configuration of the outer diameter portions 88 and 92 of rotatable member 50 are related to the curved inner face surface 96 and 96*a* of arms 72 and 72*a*. The center of openings 68 and 68*a* in which the studs 70 and 70*a* of arms 72, 72*a* are installed are located a distance from the center of the opening 64 in which stud 66 is mounted. This distance is equal to the largest radius of rotatable member 50. Curved surface 96 of the arms forms a cam follower surface for engagement with the diameter 88 of rotatable member 50. This curved surface 96 has a radius of curvature approximately equal to the radius of the larger diameter 88 of rotatable member 50 so that the cam surface 88 passes through the axial center line of studs 70 and 70*a*. The stepped surfaces 90 and 90*a* (FIGS. 4 and 5), as will be further described in the detailed description of the operation of the actuator, serve to selectively hold one or the other of the arms fixed during operation while allowing the other arm to pivot about the axis defined by the stud therefore allowing pin 42 to be shifted from one side or the other with movement of the shaft.

ASSEMBLY

Assembly of the actuator assembly is relatively simple. Arms 72 and 72*a* are positioned in frame 30 such that studs 70 and 70are pivoted in the corresponding mounting openings 68 and 68*a*, respectively. The lower surface of rotatable member 50 overlies the exposed top surface portions of studs 70 and 70*a* as the pivot stud 66 is positioned through opening 64 in the bottom wall of frame 30. Shaft 20 is inserted through the circular opening 48*a* in end wall 48 and pushed across rotatable member 50 between abutment members 86 and 86*a*. The shaft is then extended through the D-shaped opening 52*a* in end wall 52. Follower pin 42 is installed through opening 38 in shaft 20 by sliding the pin over a reduced height portion or notch 73, 73*a* on arms 72, 72*a*. Pin 42 is then shifted as required around the abutment members as shaft 20 is moved into position to receive coil spring 78 and cap 80. Coil spring 78 is positioned over the D-shaped end 32 of shaft 20 and is secured thereon by cap 80.

OPERATION

Figure 6:
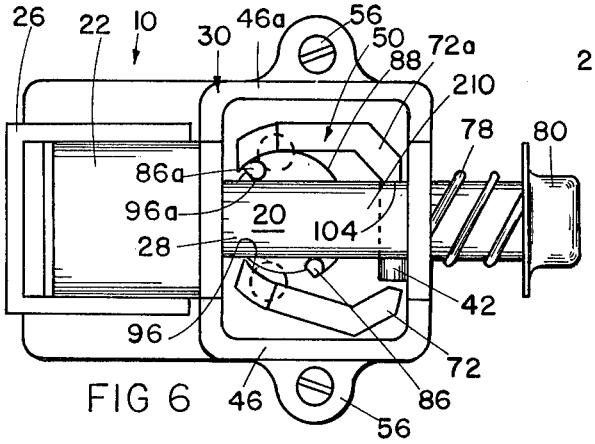
FIGS. 6 through 12 are top plan views of the actuator assembly showing successive positions of the elements thereof during two complete cycles of linear movement of the shaft.
Figure 7:
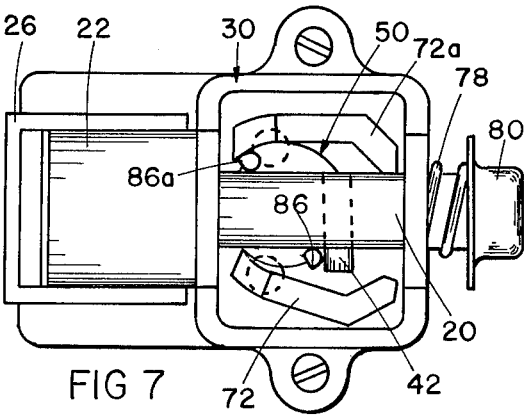
Figure 8:
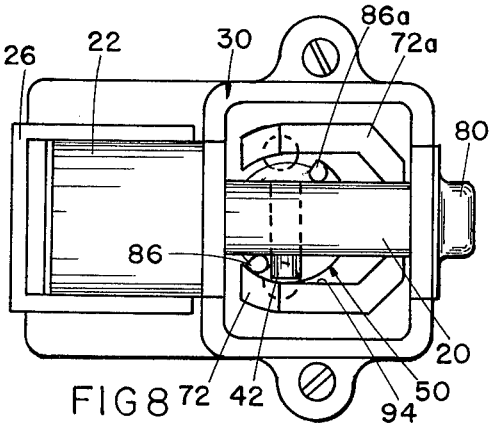

FIGS. 6 through 12 illustrate the operation of the various elements of actuator assembly 10. Referring to FIG. 6 rotatable member 50 is rotated to a full counterclockwise position and shaft 20 is biased to a first or outer position by spring 78. The outer diameter portion 88 of rotatable member 50 is in engagement with cam surface 96*a* formed on the inner face of arm 72*a*. Arm 72*a* is therefore pivoted such that flat area 104 engages shaft 20 and follower pin 42 causing the follower pin to extend through the opposite side of shaft 20 to extend outwardly toward arm 72. Shaft 20 is held in an outwardly biased position by spring 78. In FIG. 7 it is seen that as shaft 20 is drawn inwardly with actuation of the coil, shaft 20 acts as the solenoid armature and moves to the left against the bias of spring 78. Follower pin 42 engages the nearest abutment member 86 on rotatable member 50. As shaft 20 continues to move to the left, the engagement of follower pin 42 with abutment member 86 continues to rotate rotatable member 50 about stud 66 and into the position as shown in FIG. 8. Excessive rotation of rotatable member 50 is effectively stopped as pin 74 extending upwardly from bottom wall into recess 76 engages a sidewall of recess 76. As rotatable member 50 moves into this position, outer diameter surface 88 engages the curved cam follower surface 96 on arm 72 to lock arm 72 in position. At the same time the corresponding surface 96*a* on the opposite side at arm 72*a*, has disengaged and arm 72*a* is free to move.

Figure 9:
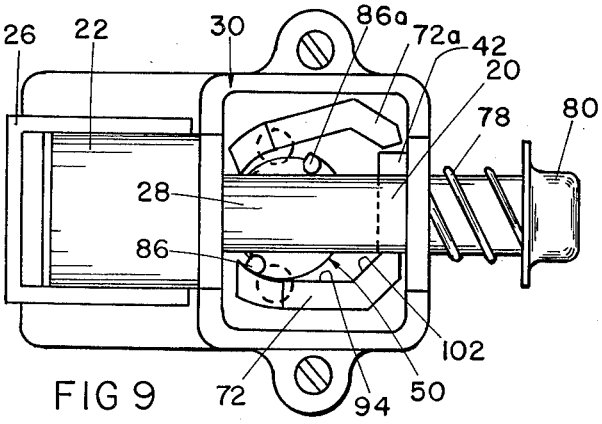

In FIG. 9 coil 22 has been deenergized and bias spring 78 has urged shaft 20 to the right into its first position. Simultaneously with movement of shaft 20 to the right, follower pin 42 rides along the inner face 94 of arm 72 following along ramp 102 where it is urged upwardly to extend from the opposite side of shaft 20. Step 36 (FIG. 2) in shaft 20 engages the inner wall surface of the D-shaped cutout 52*a* at flat surface 54 to prevent shaft 20 from pulling out of frame 30.

As movement of shaft 20 and follower pin 42 rotates plate member 50, the inner surfaces of arms 72 and 72*a* and the outer diameter surface 88 act to shift and lock the arm 72 or 72*a* nearest the outer diameter portion of the rotatable member so that the ramp end 102 and flat area 104 of arm 72 in initial contact with follower pin 42, is urged toward shaft 20 while the other arm is displaced so that its end in initial contact with pin 42 is free to move away from the shaft as the return stroke is completed.

Spring 78 attached to the outer end of shaft 20 is forced into compression by the initial motion of the shaft and since it is biased against wall 52 of framework 30 it acts to pull the shaft back to its initial starting position when the coil is deenergized (FIG. 9). As spring 78 pulls shaft 20 back to its initial starting position, arm 72 on the side of the shaft 20 through which follower pin 42 is extending acts to push the pin through the shaft and out the opposite side from which follower pin 42 initially extended.

Figure 10:
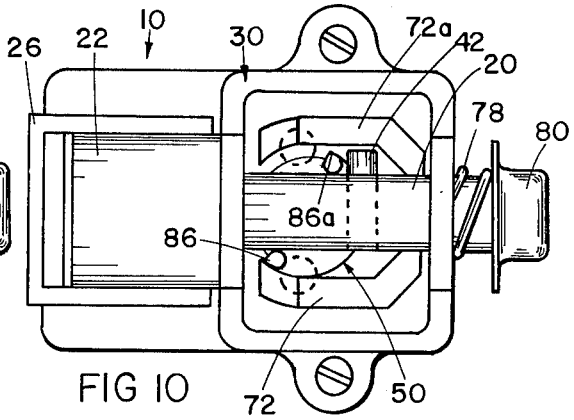
Figure 11:
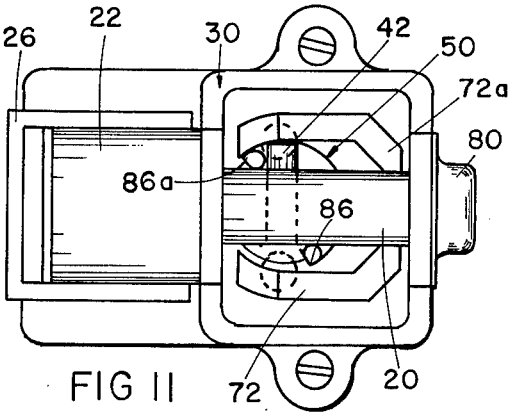
Figure 12:
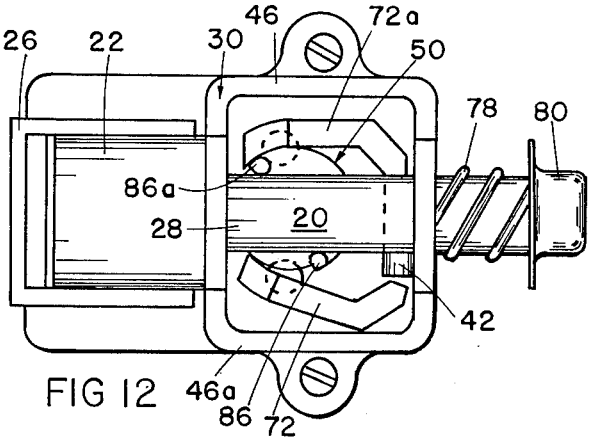

During the next cycle upon activation of the coil as shown in FIG. 10, a duplication of the above action occurs except that the oppositely mounted reciprocating parts move so as to return the arms, follower pin and rotatable member back to their original positions. In FIG. 11, for example, follower pin 42 has engaged abutment member 86*a* urging rotatable member 50 to rotate again in a counterclockwise direction. In FIG. 12 as spring 78 urges shaft 20 outwardly, follower pin 42 is urged to extend from the opposite side of shaft 20 for subsequent engagement with abutment member 86 as shown in FIG. 6.

During operation of the actuator of the invention, the importance of the previously described hole locations 64, 68 and 68*a* and the outer diameter surface 88 of rotatable member 50 and inner facing curved surfaces 96 and 96*a* of arms 72 and 72*a* is to effect an instant locking and unlocking of the arms into their camming and relaxed positions.

For purposes of discussion the camming position may be defined as that position in which either arm 72 or 72*a* will cause follower pin 42 to shift positions on either side of shaft 20. The instant change from the locked to unlocked position of arm 72 or 72*a* occurs at the time the step 90 or 90*a* of rotatable member is aligned with the center of stud 70 or 70*a* projecting downwardly from the respective arm. When step 90 or 90*a* of rotatable member 50 moves away from the center of the stud 70 in a direction toward the ramp surface 102, the arm is free to pivot and will not shift follower pin 42. As soon as step 90 crosses the center of stud 70 in the opposite direction, the arm can no longer pivot and is held in position against shaft 20 to cause displacement of pin 42 as it rides along ramp 102 and onto the flat area 104. When one of the arms is locked into position, the other arm is free to pivot. During operation, if for some reason shaft 20 or rotatable member 50 is stopped during movement and neither arm 72 or 72*a* is locked, no jamming will result. As the coil is deenergized, shaft 20 will return to its initial position and follower pin 42 will remain protruding from the same side of shaft 20 as at the beginning of the stroke. Neither arm will have any biasing influence on pin 42 so that as the coil is again energized, the mechanism will complete the stroke not previously completed.

Those skilled in the art will readily recognize that the present invention provides an actuator assembly which is of simple construction and extremely reliable in operation. Those so skilled will also readily appreciate the many advantages of the present invention and will recognize the many modifications which may be made. While a preferred embodiment of the invention has been described and illustrated in detail, it is intended that the equivalent arrangements be covered unless the following claims by their wording expressly state otherwise.

The embodiments of the invention in which an exclusive property or privilege is claimed are defined as follows:

1. An actuator assembly for converting linear movement to alternating rotational movement comprising:

a shaft member;

means mounting said shaft member for movement along its linear axis;

means for moving said shaft member between first and second positions along said linear axis;

a rotatable member mounted for rotation about an axis generally perpendicular to said linear axis;

engaging means associated with said shaft member and said rotatable member for rotating said rotatable member to produce alternating rotation in a first direction and in the opposite direction with linear movement of said shaft member between said first and second positions, said engaging means including a follower member shiftable between first and second operating positions, said follower member including a pin member on said shaft member slidably mounted for movement transverse to said linear axis, said rotatable member having a pair of abutment members thereon positioned on opposite sides of said shaft for engagement with said pin member;

means for shifting said follower member from said first operating position to said second operating position with movement of said shaft member between said first and second positions, said shifting means including a pair of arm members pivotally mounted on said mounting means for movement about axes perpendicular to said linear axis; and first cam means on said rotatable member engageable with said arm members to alternately pivot said arm members into engagement with said pin member to urge said pin member into a position for engagement with one of said pair of abutment members with movement of said shaft between said first and second positions, said follower member in said first operating position urging said rotatable member to rotate in said first direction and in said second operating position urging said rotatable member to rotate in the opposite direction.

2. The actuator assembly of claim 1 wherein a first cycle of movement of said shaft between said first and said second positions urges said rotatable member to rotate in said first direction and wherein a second cycle of movement of said shaft between said positions urges said rotatable member to rotate in said opposite direction.

3. The actuator assembly of claim 1 and further including cam follower means on said arm members, said cam follower means operable with said first cam means on said rotatable member for urging said arm members to pivot into engaging position with said pin member; and second cam means of said arm members operatively engaging and urging said pin member along said axis transverse to said linear axis of said shaft member.

4. The actuator assembly of claim 3 and further including locking means on said rotatable member and said arm members, said locking means selectively holding one of said pair of arm members from movement as said shaft member moves from said second position to said first position, said second cam means on said one of said arm members urging said pin member to extend from one side of said shaft for engagement with the other of said pair of said abutment members as said shaft member is subsequently moved to said second position.

5. The actuator assembly of claim 4 wherein said moving means includes motor means for shifting said shaft member from one of said first and said second positions to the the other of said positions.

6. The actuator assembly of claim 5 wherein said motor means is a solenoid having a coil and an armature, said shaft member having a portion thereof forming said armature.

7. The actuator assembly of claim 6 wherein said moving means further includes biasing means operatively engaging said shaft member, said biasing means urging said shaft member from said other of said positions to said one of said positions.

8. The actuator assembly of claim 1 and further including cooperating locking means on said rotatable member and said pair of arm members, said locking means holding one of said pair of arm members from movement as said shaft member moves between said positions.

9. The actuator assembly of claim 8 and further including cam means on said arm members for guiding said pin member for movement along said transverse axis, said cam means selectively operable on said pin member with locking of selected one of said pair of arm members.

10. An actuator assembly for converting linear movement to rotational movement comprising an elongated first member; means for producing linear movement of said first member in both axial directions; rotatable means associated with said first member; engaging means on said first member engagable with said rotatable member to produce alternating clockwise and counterclockwise rotational movement thereof; said rotatable means having a pair of abutment members thereon located on each side of said first member with said first member being mounted for relative movement therebetween; said engaging means including a follower pin extending through a transverse bore in said first member; and means for alternately shifting said follower pin to extend alternately from opposite sides of said first member so as to alternately engage said abutment members to cause said alternating clockwise and counterclockwise rotation of said rotatable means after each cycle of axial movement of said first member.

11. An actuator assembly according to claim 10 wherein said abutment members are secured on and extend upwardly from said rotatable means; said rotatable means being positioned adjacent said first member and having as axis of rotation generally perpendicular to the linear axis of said first member; said means for alternately shifting said follower pin including a pair of arm members pivotally mounted adjacent said rotatable means, each arm, when said first member is in a starting position in each cycle, being in abutting contact at one end with said follower pin and at the other end with said rotatable means, said shifting means acting to move said arm so as to shift said follower pin during each cycle of linear movement of said first member so as to alternately engage said abutment members after each cycle of movement of said first member.

12. An actuator assembly according to claim 11 wherein said means for producing linear movement of said first member in one of said directions is an electromagnetic means.

13. An actuator assembly according to claim 11 wherein said means for producing linear movement of said first member in the other of said directions includes biasing means urging said first member in the other of said directions.

14. An actuator assembly according to claim 13 wherein said biasing means is a coil spring.

15. In combination with a locking mechanism including a movable lock activating element, an actuator assembly for converting linear movement to rotational movement so as to move said lock activating element between locked and unlocked positions, said assembly comprising: a first member; means for producing linear movement of said first member in both axial directions; a second member mounted for rotation about an axis perpendicular to the axis of movement of said first member; engaging means associated with said first member to produce alternating clockwise and counterclockwise rotational movement of said second member; means for alternating the direction of said rotational movement of said second member after each cycle of linear movement of said first member; said second member including abutment members located adjacent said first member on opposite sides of said axis of movement with said first member being mounted for linear movement between said abutment members; a follower pin extending through a transverse bore in said first member so as to alternately engage said abutment members to cause said alternating clockwise and counterclockwise rotation of said second member as said first member moves linearly through said cycles of movement.

16. An actuator assembly according to claim 15 wherein said abutment members are secured on and extend upwardly from said second member; said means for alternating the direction of rotational movement of said second member including a pair of arm members pivotally mounted adjacent said second member for alternate operation therewith, each arm, when said first member is in a starting position in each cycle, alternately being in abutting contact at one end with said follower pin and at the other end with a camming surface on said second member, said camming surface acting to move said arm so as to shift said follower pin during each cycle of linear movement of said first member so as to alternately engage said abutment members after each cycle of linear movement.

17. An actuator assembly according to claim 16 wherein said second member is interconnected to said lock activating element so that as said second member is selectively rotated in response to linear movement of said first member, said locking mechanism is selectively locked and unlocked.

* * * * *